US006122946A

United States Patent [19]

Blanch

[11] Patent Number: 6,122,946

[45] Date of Patent: Sep. 26, 2000

[54] KEY CONTROLLED LATCH

[75] Inventor: David Garfield Blanch, Notting Hill, Australia

[73] Assignee: Lockwood Australia Pty. Ltd., Australia

[21] Appl. No.: 09/125,127

[22] PCT Filed: Feb. 11, 1997

[86] PCT No.: PCT/AU97/00070

§ 371 Date: Aug. 11, 1998

§ 102(e) Date: Aug. 11, 1998

[87] PCT Pub. No.: WO97/30256

PCT Pub. Date: Aug. 21, 1997

[30] Foreign Application Priority Data

Feb. 14, 1996 [AU] Australia ..... PN8040

[51] Int. Cl.[7] ..... E05B 55/04

[52] U.S. Cl. ..... 70/473; 70/475; 70/477; 70/482; 70/485

[58] Field of Search ..... 70/469, 471, 473–477, 70/481–485, 478–480

[56] References Cited

U.S. PATENT DOCUMENTS

| | | | |
|---|---|---|---|
| 1,804,482 | 5/1931 | Reif | 70/482 X |
| 1,843,143 | 2/1932 | Rymer | 70/477 X |
| 2,207,143 | 7/1940 | Brauning | 70/477 X |
| 2,282,213 | 5/1942 | Rolph | 70/480 |
| 2,293,856 | 8/1942 | Schlage | 70/480 |
| 2,719,424 | 10/1955 | Rayburn | 70/480 X |
| 2,788,996 | 4/1957 | Shoalts | 70/482 X |
| 2,959,953 | 11/1960 | Scheitzer | 70/479 X |
| 2,966,054 | 12/1960 | Muttart | 70/480 X |
| 3,422,645 | 1/1969 | Sato . | |
| 3,819,214 | 6/1974 | Hart et al. | 292/169.13 |
| 4,333,324 | 6/1982 | Dietrich et al. | 70/107 |
| 4,635,453 | 1/1987 | Hart | 70/134 |
| 4,777,810 | 10/1988 | Webster | 70/481 X |

FOREIGN PATENT DOCUMENTS

| | | |
|---|---|---|
| 328 325 | 3/1976 | Australia . |
| 12029/88 | 9/1988 | Australia . |
| 38167/89 | 2/1990 | Australia . |
| 66671/90 | 6/1991 | Australia . |
| 1121611 | 4/1982 | Canada . |
| 0 229 514 | 7/1987 | European Pat. Off. . |
| 1173808 | 3/1959 | France . |
| 571 766 | 3/1933 | Germany . |
| 1 439 696 | 6/1976 | United Kingdom . |
| 2 164 992 | 4/1986 | United Kingdom . |

*Primary Examiner*—Lloyd A. Gall
*Attorney, Agent, or Firm*—Lerner, David, Littenberg, Krumholz & Mentlik, LLP

[57] ABSTRACT

Latch assemblies are disclosed including a latch bolt mounted on a casing for relative movement between an extended latching position and a retracted release position, a first actuator operable from the inner side of the assembly to cause movement of the latch bolt to the release position, a lock operable from the inner side of the assembly to adopt an active condition thus render the first actuator inoperable, a second actuator operable from an outer side of the assembly to cause movement of the latch bolt to the release position, and a lock release responsive to operation of the second actuator to render the lock inactive.

32 Claims, 6 Drawing Sheets

49
36
48
34
34
31
41
38
33
35
32
35
22
23
40
23
27
24
30
15
13
14
13
14
16
18
26
21
28
21
18
20
29
9
50
46
47
42
17

KEY CONTROLLED LATCH

FIELD OF THE INVENTION

This invention relates to latches of the kind which are controlled by a key operable lock and which are intended for use on doors and other movable members adapted to close an access opening. It will be convenient to hereinafter describe the invention with particular reference to doors, but the invention has wider application.

BACKGROUND OF THE INVENTION

Latch assemblies for doors commonly include a turn knob or handle which is generally located at the inside of the door and which is rotated to withdraw the latch bolt into its casing. In order to improve the security of such assemblies, manufacturers have included a key operated lock which is operative to releasably hold the turn knob or handle against rotation. Such locks are typically arranged so as to be operated from the inside of the door and are not operable from the outside of the door. In particular, key operation of the latch from the outside of the door will not release the lock. That can lead to serious problems in circumstances where the door needs to be opened urgently from the inside, particularly if the lock key has been misplaced or is not conveniently accessible.

It is an object of the present invention to provide a key controlled latch which can be released from a locked condition by use of a key at the outside of the door or other member with which the latch is used.

A typical latch assembly to which the present invention is applicable includes a casing, a latch bolt movable relative to the casing to adopt either an extended latching position or a retracted release position, a first actuator at an inner side of the assembly which is operable to move the latch bolt to the release position, locking means which is rendered active or inactive by key operation from the inner side of the assembly and which when active renders the first actuator inoperable, and a second actuator at an outer side of the assembly which is operable to move the latch bolt to the release position.

In normal latch assemblies of the foregoing kind operation of the outer or second actuator does not affect the operation of the locking means. That locking means remains active in spite of operation of the outer actuator, and can be rendered inactive only by appropriate and deliberate operation of the locking means from the inner side of the latch assembly. It is usually the case in such prior assemblies that the locking means is key operated. That is, the locking means will generally include a key operated tumbler lock and locking mechanism connected to that lock so as to be influenced by operation of the lock. The second or outer actuator may also include a key operated tumbler lock, but in conventional assemblies of the foregoing kind operation of that lock does not influence operation of the first actuator locking means. The two locks are arranged so that one is operated from the inner side of the assembly and the other is operated from the outer side.

SUMMARY OF THE INVENTION

According to the present invention, a latch assembly of the foregoing kind is characterised in that it includes lock release means which is responsive to operation of the second actuator to render the locking means inactive.

The first actuator will generally include a rotatable knob or handle which is connected to the latch bolt in a known manner so as to be operable to move that bolt into the release position, and the bolt may be spring biased into the latching position. The locking means preferably includes at least one cam controlled detent which is movable between actuator locking and actuator release positions. It is also preferred that the lock release means is operable to influence the detent cam in a manner such that operation of the second or outer actuator causes the detent cam to move to a position corresponding to the actuator release position of the detent. The cam may be spring biased towards that corresponding position, and retaining means may be operable to allow or prevent such movement according to whether or not, respectively, the second actuator is operated.

BRIEF DESCRIPTION OF THE DRAWINGS

Embodiments of the invention are described in detail in the following passages of the specification which refer to the accompanying drawings. The drawings, however, are merely illustrative of how the invention might be put into effect, so that the specific form and arrangement of the various features as shown is not to be understood as limiting on the invention.

In the drawings.

DETAILED DESCRIPTION

Figure 1:
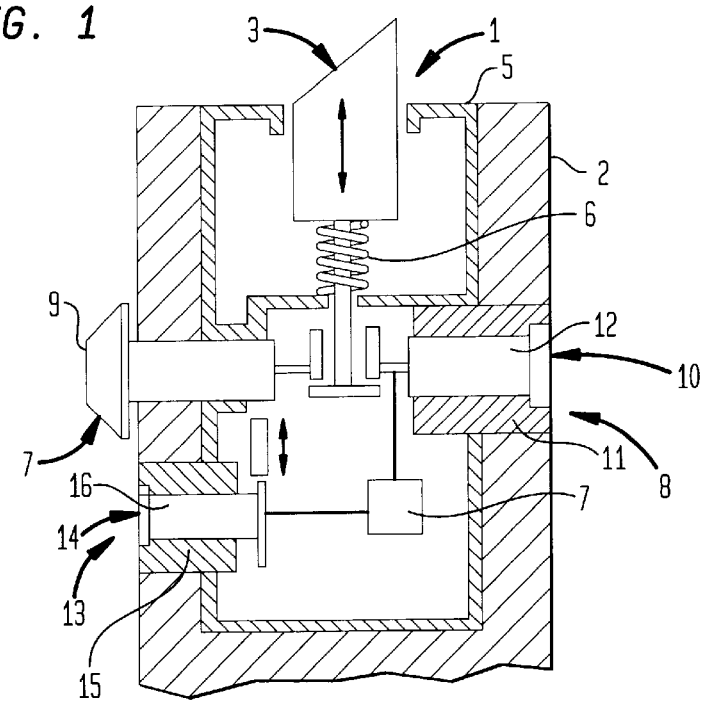
FIG. 1 is a diagrammatic view of an installation including a latch assembly according to one embodiment of the invention.

FIG. 1 shows, in very diagrammatic form, a latch assembly 1 incorporating one embodiment of the invention which is shown mounted in an edge of a door 2. The assembly 1 includes a latch bolt 3 which is movable between an extended latching position, as shown, and a retracted position in which the head 4 of the bolt 3 is at least substantially contained within the assembly casing 5. A spring 6 urges the bolt 3 towards the latching position, and the bolt 3 can be withdrawn into the retracted position by operation of either an inner actuator 7 or an outer actuator 8. In that respect, "inner" and "outer" respectively relate to the inner side and the outer side of the door 2 relative to the space to which access is controlled by the door 2.

The inner actuator 7 may include a rotatable member such as a turn knob or handle, and in the arrangement shown includes a rotatable turn knob 9. That knob 9 can be connected to the latch bolt 3 in any appropriate manner such that rotation of the knob 9 causes linear movement of the bolt 3 into the retracted position. Such connections are well known in the relevant art.

The outer actuator may include a key operated lock 10, and in a typical arrangement that lock includes a body or cylinder 11 and a barrel 12 rotatably mounted in the cylinder 11. Tumblers (not shown), such as pin tumblers, may interact between the cylinder 11 and the barrel 12 in a known manner so as to prevent relative rotation of the barrel 12 unless a correctly cut key is inserted into a key way (not shown) of the barrel 12. The barrel 12 is connected to the latch bolt 3 in a manner such that rotation of the barrel 12 is operative to cause movement of the bolt 3 into the retracted position, and such connections are well known in the art.

Selectively operable locking means 13 is provided to enable the turn knob 9 to be rendered inoperable. Such locking means can be of any suitable form, and one particular form will be hereinafter described. It is preferred that the locking means includes a key operated lock 14, and in a typical arrangement that lock includes a body or cylinder 15 and a barrel 16 rotatably mounted in the cylinder 15. Tumblers (not shown), such as pin tumblers, may interact between the cylinder 15 and the barrel 16 in a known manner so as to prevent relative rotation of the barrel 16 unless a correctly cut key is inserted into a key way (not shown) of the barrel 16. The cylinder 15 may be mounted within the turn knob 9 as hereinafter described so as to be held against movement relative to the knob 9, and the barrel 16 may be connected to other parts of the locking means 13 in any appropriate fashion.

In a typical arrangement the two locks 10 and 14 are able to be operated by the same key, but that is not essential.

It is a feature of the assembly 1 that it includes lock release means 17 which responds to operation of the lock 10 so as to automatically deactivate the locking means 13., The release means may take any suitable form, and one particular form will be hereinafter described.

Figure 2:
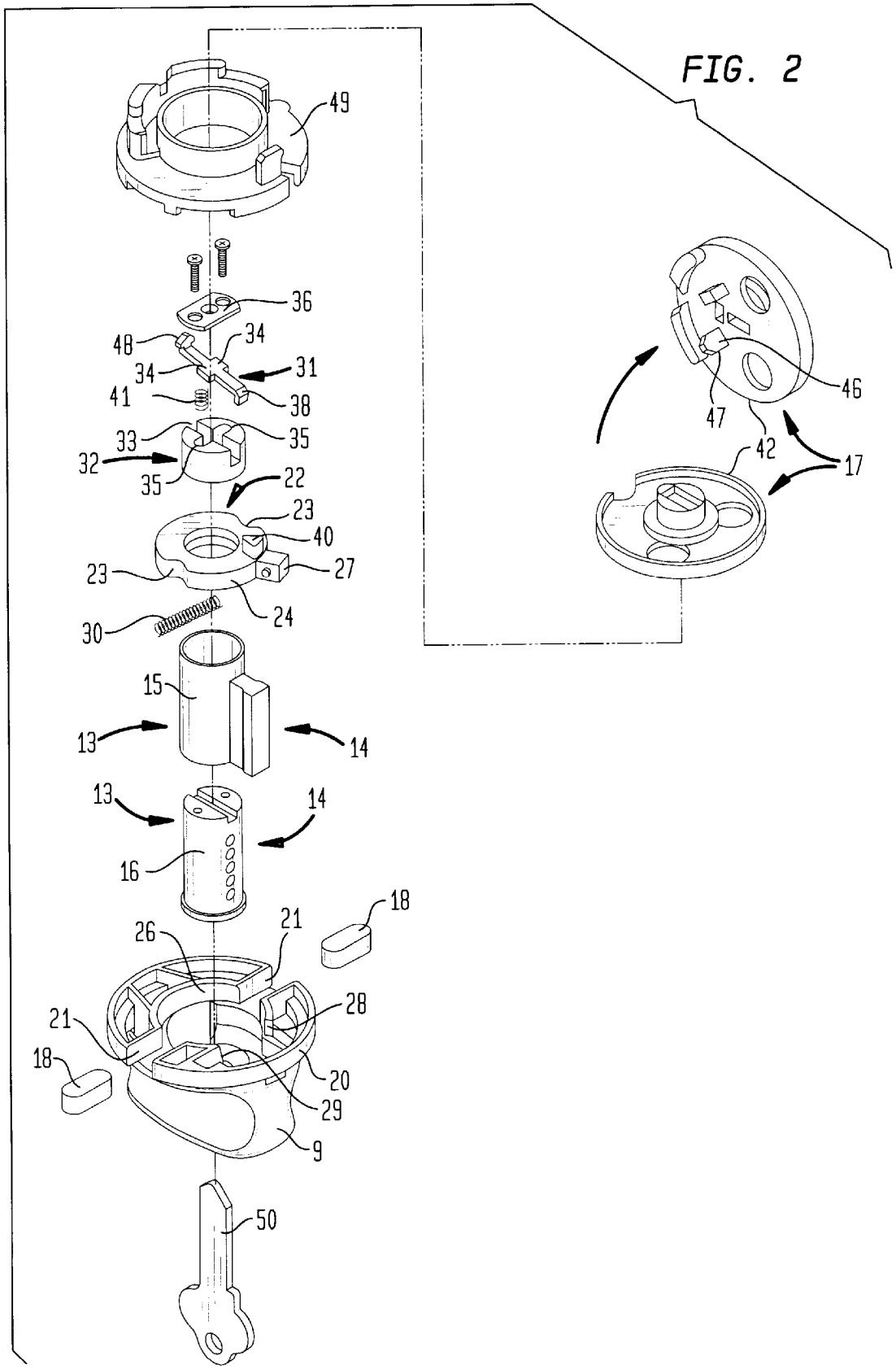
FIG. 2 is an exploded view of part of a latch assembly according to an embodiment of the invention and which omits the outer actuator of the assembly.

FIG. 2 is an exploded view of part of one particular construction according to the invention, and shows that part of a latch assembly incorporating the locking means 13 and the release means 17. Other Figures give a clearer picture of how some of the relevant components cooperate with one another.

The locking means 13 of the construction shown in FIG. 2 includes the lock 14 and two detents 18 which are cooperable with the turn knob 9 and which are controlled in a manner hereinafter explained. Although two detents 18 are shown, it will be appreciated that a single detent 18 could be used. In the particular arrangement shown, each of the detents 18 is of elongate form and is slidably mounted on the turn knob 9 so as to be movable in the direction of the longitudinal axis of the detent 18 and so as to be engageable with a fixed part of the casing 5, or a member attached to casing 5. The detents 18 are located on opposite sides of the rotational axis of the turn knob 9 and are movable in opposite directions radial of that axis.

Figure 3:
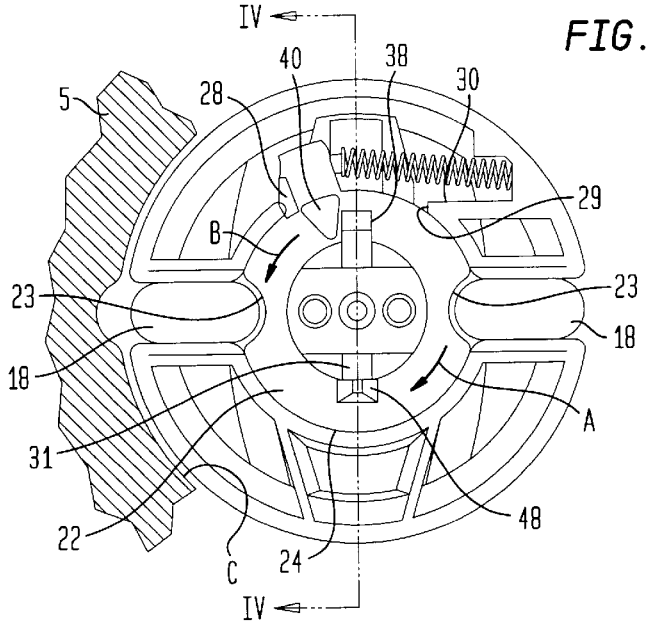
FIG. 3 is an end view of the part of the assembly shown by FIG. 2 and in which parts have been omitted for convenience of illustration.
Figure 5:
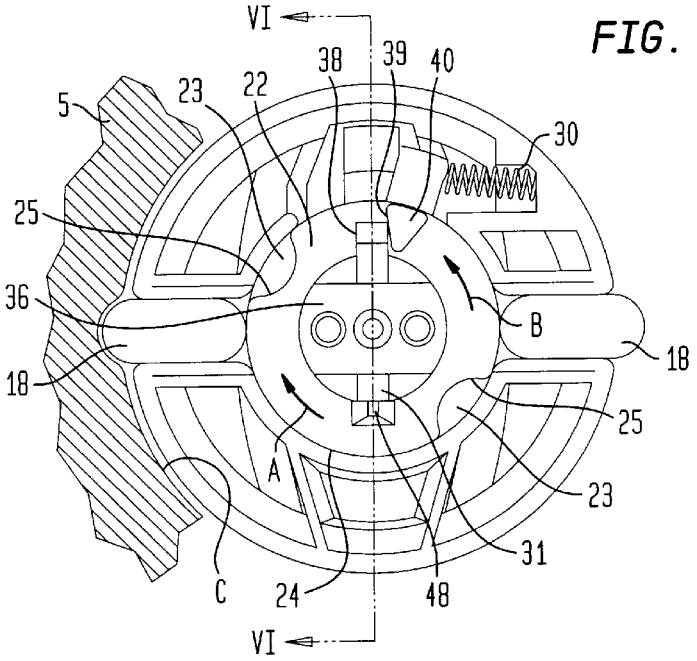
FIG. 5 is a view similar to FIG. 3 but showing the assembly with the locking means of the inner actuator in an active condition.

When the locking means 13 is inactive, each of the detents 18 is fully contained in a cylindrical cavity C, part of which is shown in FIGS. 3 and 5. An inner hub 20 of the turn knob 9 which carries the detents 18 is located within the cavity C, and when the detents 18 are in the position shown by FIG. 3 they do not hinder rotation of the knob 9. When the locking means 13 is active, the detents 18 are moved radially outwards beyond the periphery of the hub 20 as shown by FIG. 5 so as to engage the casing 5 or a member attached thereto. In the arrangement shown each detent 18 is slidably mounted in a respective one of two locking recesses 21 formed in the knob hub 20 and thereby coact with the knob 9 to prevent rotation of the knob 9 when the detents 18 are positioned as shown in FIG. 5 to engage the casing 5 or a member attached thereto. It will be appreciated that other arrangements and other forms of locking means could be adopted.

In the particular arrangement shown, movement of the detents 18 is controlled by a rotatable cam 22, and the example cam 22 as shown includes two recesses 23 formed in the peripheral surface 24 and arranged in diametrically opposed relationship. As shown by FIG. 3, each of the recesses 23 receives an inner end portion of a respective one of the detents 18 when the locking means 13 is inactive. As shown by FIG. 5, the inner end of each detent 18 engages against the peripheral surface 24 when the locking means 13 is active. A sloping ramp surface 25 extends between the base of each recess 23 and the surface 24 so as to progressively move the detents 18 radially outwards when the cam 22 is rotated relative to the hub 9 in one particular direction as shown by the arrow "A" in FIG. 5.

Any suitable connection may be provided between the cam 22 and the turn knob 9 so as to cause the cam 22 to rotate in an appropriate manner in response to rotation of the turn knob. In the particular arrangement shown the cam 22 is located within a cylindrical cavity 26 (FIG. 2) of the turn knob 9 so as to be capable of limited rotation relative to the turn knob 9. An arm 27 projects laterally from an outer surface of the cam 22 and is positioned between two stops 28 and 29 formed within the turn knob 9. Relative rotation between the cam 22 and the turn knob 9 is limited by the spacing between the stops 28 and 29 and the thickness of the arm 27. It is preferred as shown that a spring 30 acts between the turn knob 9 and the cam arm 27 so as to normally urge the arm 27 against the stop 28 (FIGS. 3, 7 and 9), but other arrangements could be adopted for that purpose.

Figure 9:
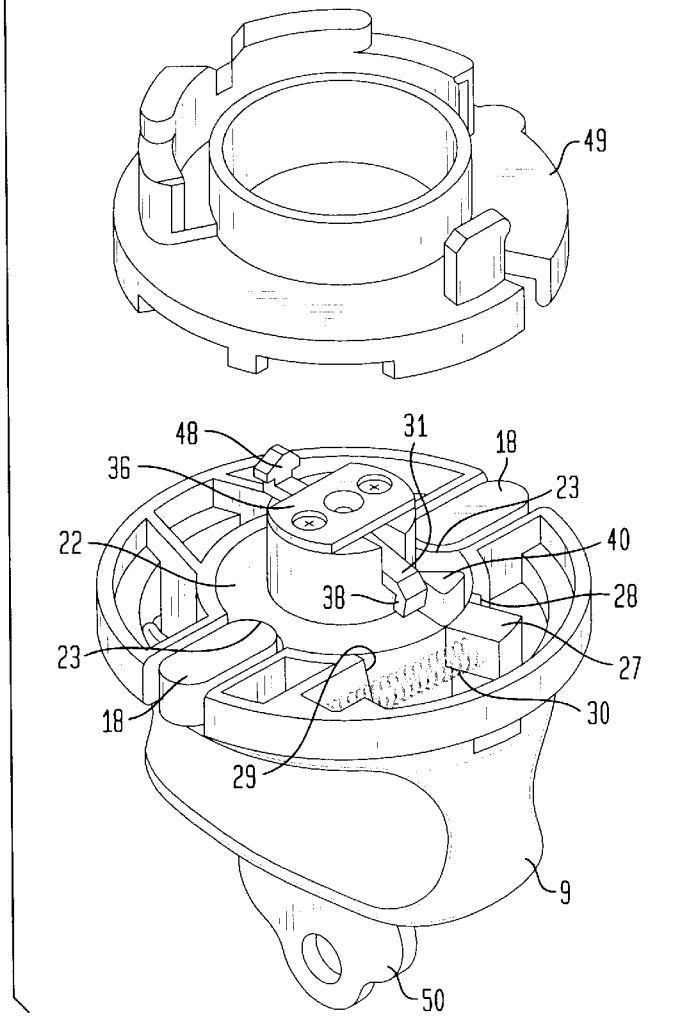
FIG. 9 is a partially exploded perspective view of the assembly part shown by FIGS. 2 to 8.

It will be observed from FIGS. 3 and 9 that the detents 18 are inactive when the relative rotational positions of the cam 22 and the turn knob 9 are such that the arm 27 engages the stop 28, which will be hereinafter referred to as the first position of rotation of the cam 22. When the cam 22 is rotated relative to the turn knob 9 so as to engage against or locate adjacent the stop 29 (the second position of rotation) the detents 18 are cammed into the active position as shown by FIG. 5. The spring 30 tends to move the cam 22 back to the FIG. 3 position and releasable retainer means is provided to prevent that movement.

Figure 6:
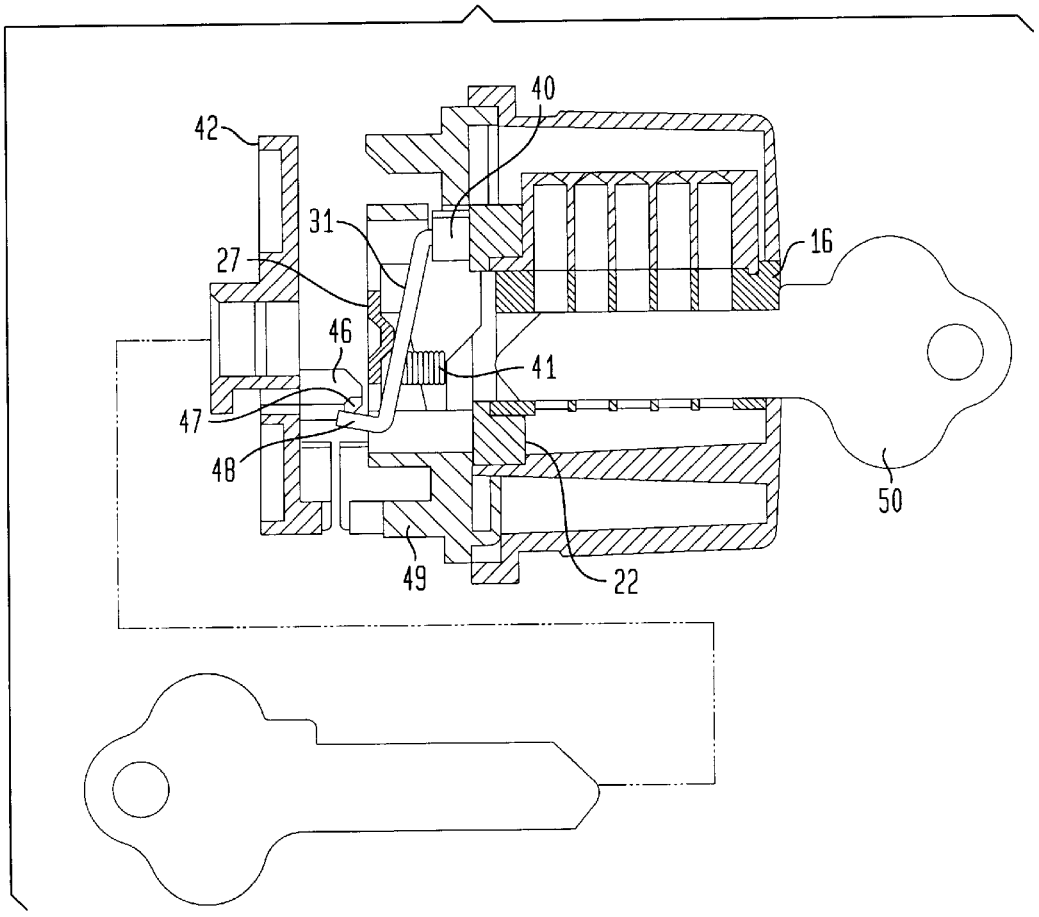
FIG. 6 is a sectional view taken along line VI—VI of FIG. 5.
Figure 7:
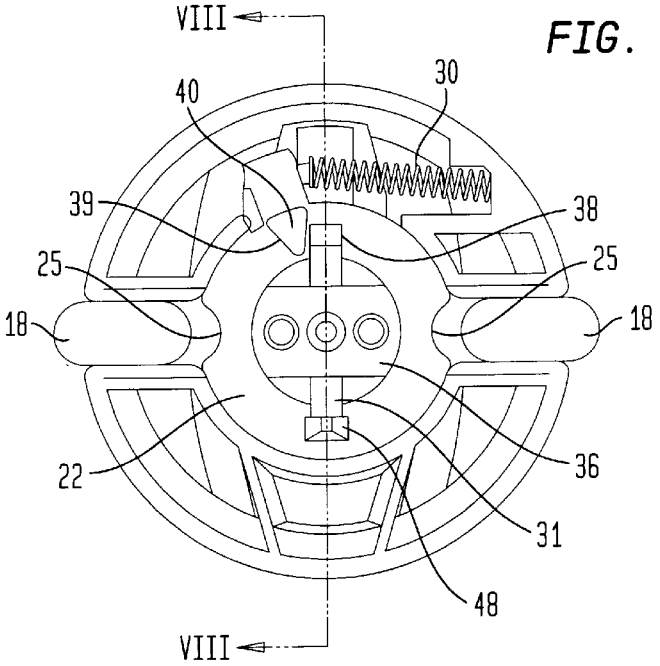
FIG. 7 is a view similar to FIG. 5 but showing the locking means ready to return to the inactive condition.
Figure 8:
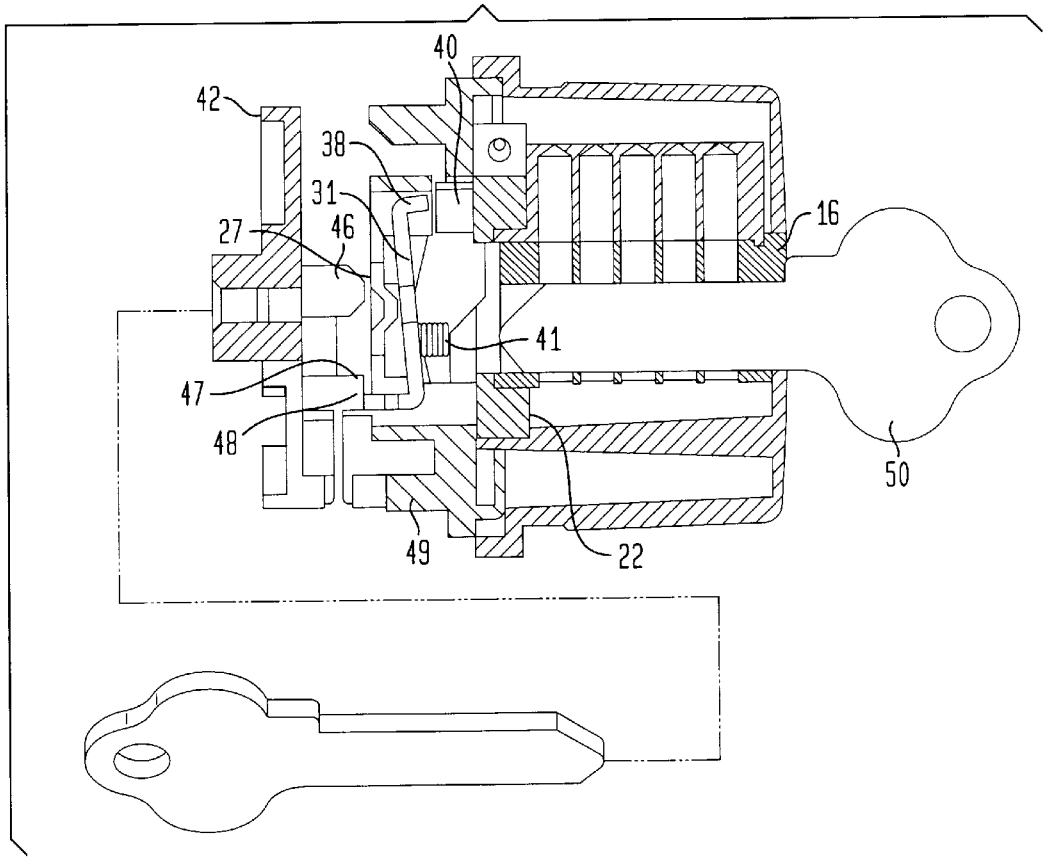
FIG. 8 is a cross sectional view taken along line VIII—VIII of FIG. 7.
Figure 10:
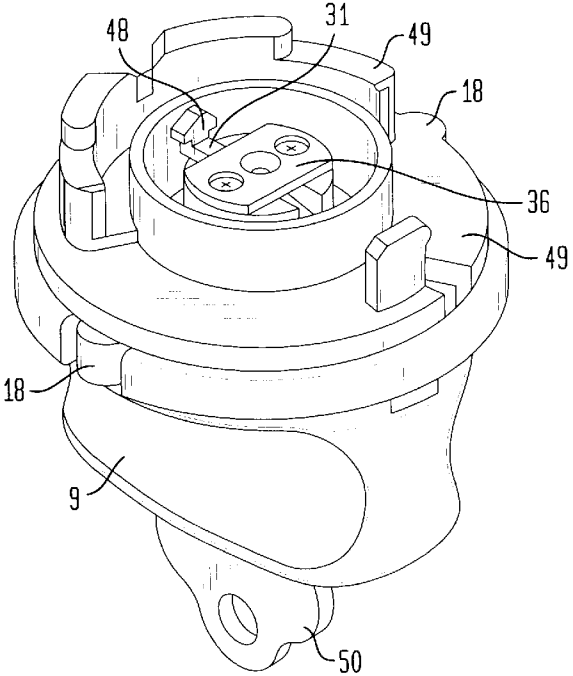
FIG. 10 is a view similar to FIG. 9 but showing the drive plate mounted on the turn-knob of the assembly.

In the particular arrangement shown the cam retainer means includes a member which can be moved into and out of cooperative engagement with the cam 22. Preferably that member is in the form of a lever 31 which is mounted for rocking or pivotal movement between cam retaining and cam release positions respectively. The cam retaining position is shown by FIGS. 5 and 6 and the cam release position is shown by FIGS. 7 and 8. It is further preferred that the lever 31 is connected to the lock barrel 16 for rotation with that barrel.

In the particular arrangement shown, the lever 31 is carried by a cylindrical turret 32 which is connected to the lock barrel 16 for rotation with that barrel. The lever 31 is nested within a transverse slot 33 of the turret 32 so as to be movable between the cam retaining position as shown in FIGS. 5 and 6, and the cam release position as shown in FIGS. 7 and 8. For the purpose of that movement, which is essentially pivotal movement, each of two lateral wings 34 of the lever 31 locate within a respective recess 35 of the turret 32. The lever 31 is held in assembly with the turret 32 by an overlying plate 36, and a projection 37 at the undersurface of the plate 36 bears against the upper surface of the lever 31 to facilitate pivotal movement of the lever 31. Other types of pivotal mounting could be adopted. A downturned lug 38 at one end of the lever 31 cooperates with the cam 22 as described below.

When the lever 31 is in the cam retaining position (FIGS. 5 and 6) the lug 38 engages against a side 39 of a projection 40 which is upstanding from an upper surface of the cam 22. Biasing means preferably urges the lever 31 into a pivotal position at which engagement between the lug 38 and the projection 40 can occur, and in the arrangement shown that biasing means includes a spring 41 which acts between the turret 32 and the lever 31.

In the situation shown by FIG. 5 the turn knob 9 is held against rotation by the detents 18 engaging with the casing 5 or a member secured thereto. The cam 22 is attached to the turn knob 9 as previously described and consequently cannot move relative to the turn knob in the direction of arrow "B". Also, the lever 31 is unable to rotate about the axis of the cam 22 because of its connection with the lock barrel 16 which cannot rotate relative to the cylinder 15 until released by an appropriate key.

Figure 11:
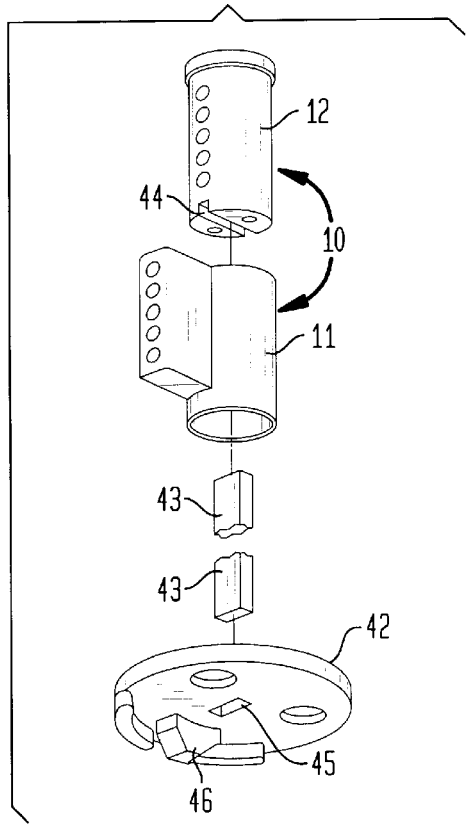
FIG. 11 is an exploded view of an outer actuator suitable for use with the part of the assembly shown by FIGS. 2 to 10.

Lock, release means is provided to enable the lever 31 to be moved out of blocking engagement with the cam projection 40. In the particular arrangement shown, the lock release means 17 is arranged to have direct influence on the cam retainer means, and it is preferred that such influence is achieved through a rotatable camming member 42 which forms part of the release means 17 and is connected to the outside lock 10 so as to rotate in response to rotation of the lock barrel 12. As shown by FIG. 11, that connection may include a drive bar 43 of non-circular cross-sectional shape which engages at one end within a slot 44 in an end of the barrel 10, and engages at its other end in a rectangular aperture 45 formed through the camming member 42.

Figure 4:
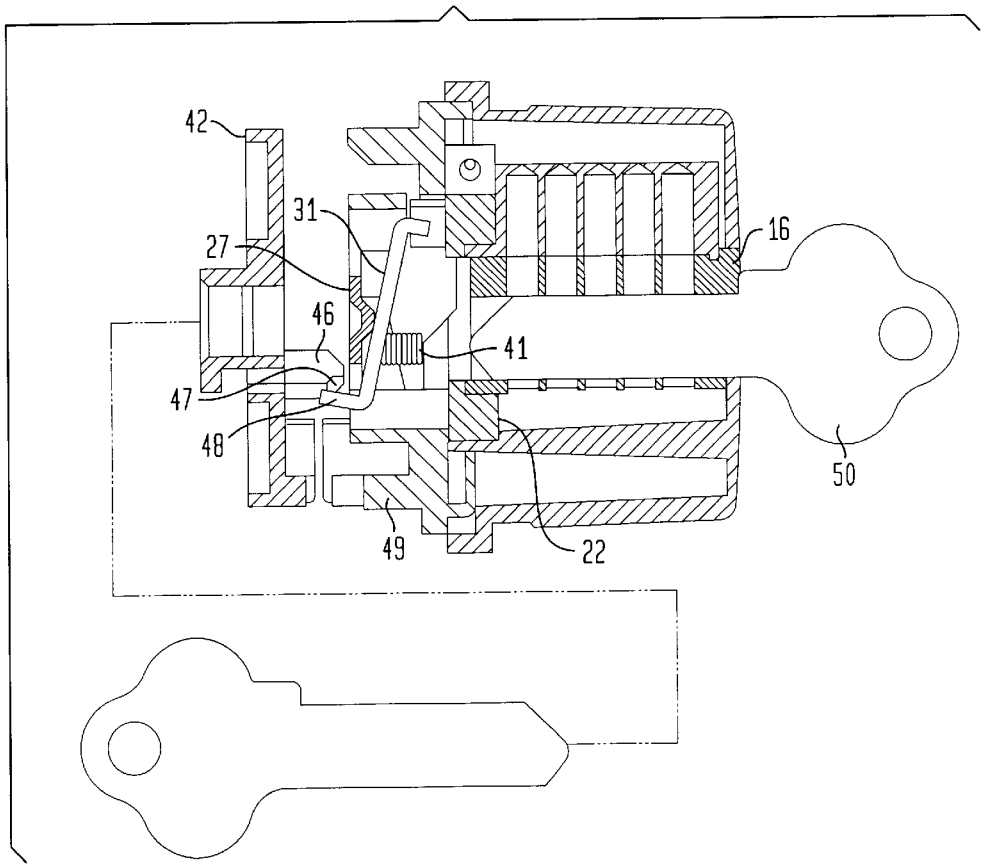
FIG. 4 is a cross sectional view taken along line IV—IV of FIG. 3.

As best seen in FIGS. 4, 6 and 8, the camming member 42 is arranged to overlie the lever 31 at the side of that lever remote from the cam 22. A camming lug 46 provided on the member 42 has a sloping cam face 47 which is adapted to engage against an upstanding portion 48 of the lever 31 which projects above the plate 36, as shown in FIGS. 4, 6 and 8, when the lever 31 is in the cam retaining position. Rotation of the member 42 caused through operation of the lock 10, results in coaction between the cam face 47 and the lever portion 48 such that the lever 31 is progressively forced downwards against the action of the spring 41 towards the position shown in FIG. 8.

Having now described the principle components of the embodiment of the invention shown in the drawings, the operation of that embodiment is as follows.

When the lock 14 is in a released condition the cam 22 and the detents 18 will be positioned as shown by FIG. 3. The turn knob 9 is thus able to be rotated as required to operate the latch bolt 3. In that regard, the knob 9 may coact with the latch bolt mechanism through a drive plate 49 in a known manner.

If it is desired to lock the turn knob 9 against rotation the lock barrel 16 is turned in the direction of arrow "A" (FIGS. 3 and 5) by means of an appropriate key 50. The lock barrel 16 is turned through approximately 360 degrees from the position shown in FIG. 3 to the position shown in FIG. 5. During a final part of that movement the lever lug 38 engages against the side 39 of the cam projection 40 and thereby pushes the cam 22 against the influence of the spring 30 so that the cam 22 is moved from the first position of rotation shown by FIG. 3 to the second position of rotation shown by FIG. 5. As a consequence the detents 18 are cammed out of the recesses 23 to lock the turn knob 9 against rotation.

Rotation of the cam 22 relative to the turn knob 9 in the direction of arrow "B" (FIG. 5) is prevented by coaction between the lever lug 38 and the cam projection 40. In that regard, the lock barrel 16 (FIG. 6) is held against rotation in the direction of arrow "B" by the action of the lock tumblers (assuming there is no key in the lock), and the lever 31 is unable to rotate about the barrel axis independent of the barrel 16.

It will be apparent that the restraining influence of the lever 31 does not prevent a key 50 being used to turn the lock barrel 16 in the direction of arrow "B" so as to return the barrel 16 from the FIG. 5 position to the FIG. 3 position. On the other hand, operation of the outer lock 10 will remove the restraining influence of the lever 31 in the following manner.

Rotation of the lock barrel 12 causes corresponding rotation of the camming member 42 through the connection described by reference to FIG. 11. As the camming member 42 rotates with the lock barrel 12 the cam face 47 engages the lever portion 48 and thereby progressively pushes the lever 31 down against the influence of the spring 41. As a consequence the lever 31 is eventually caused to adopt the position shown by FIG. 8 at which the lever lug 38 no longer blocks movement of the cam projection 40. The cam 22 is thereby free to rotate relative to the turn knob 9 in the direction of arrow "B" under the influence of the spring 30 and the projection 40 is thereby able to adopt a position relative to the lever 31 as shown by FIG. 7. Furthermore, the aforementioned movement of the cam 22 places the cam recesses 23 in a position such that the detents 18 can move inwards to adopt the inactive condition. That inward movement of the detents 18 might occur automatically, or it might occur as a consequence of the rotation of the turn knob 9. In that regard, the outer end of each detent may be rounded or otherwise shaped so that turning movement of the knob 9 relative to the casing 5 imposes a force on each detent 18 which has a component acting in the longitudinal direction of the detent 18.

When the cam 22 has adopted the FIG. 7 position it will retain that position under the influence of the spring 30 unless forced out of that position by operation of the lock 14. Consequently, the turn knob locking means 13 is automatically deactivated when the lock 10 is operated and it remains deactivated until deliberately returned to the active condition by operation of the lock 14.

It will be appreciated from the foregoing description that the present invention provides a relatively simple means for deactivating the knob locking mechanism from a position outside the door with which the latch assembly is associated. Furthermore, the release operation is of a positive nature such that release will always occur each time the outside lock (or other actuator) is operated to withdraw the latch bolt.

Various alterations, modifications and/or additions may be introduced into the constructions and arrangements of parts previously described without departing from the spirit or ambit of the invention as defined by the appended claims.

What is claimed is:

1. A latch assembly including, a casing, a latch bolt mounted on the casing so as to be movable relative thereto between an extended latching position and a retracted release position, a first actuator operable from an inner side of the assembly to cause movement of the latch bolt to said release position, locking means operable from said inner side of the assembly to adopt an active condition and thereby render said first actuator inoperable, a second actuator operable from an outer side of the assembly to cause movement of the latch bolt to the release position, lock release means which is responsive to said operation of the second actuator so as to thereby render said locking means inactive, said locking means including a cam member which is movable between first and second positions at which said locking means is inactive and active respectively, cam biasing means urging said cam member towards said first position, and a retaining member engageable with said cam member to thereby prevent movement of said call member out of said second position when said locking means is in the active condition.

2. A latch assembly according to claim 1, wherein said second actuator includes a key operated lock.

3. A latch assembly according to claim 1, wherein said locking means includes a key operated lock.

4. A latch assembly according to claim 1, wherein said first actuator includes a member which is movable about an axis of rotation, and means connects said actuator member to said latch bolt so that said latch bolt movement occurs in response to rotation of said actuator member.

5. A latch assembly according to claim 4, wherein said connecting means includes a drive plate which is mounted for rotation about said actuator member axis.

6. A latch assembly according to claim 4, wherein said locking means includes a key operated lock which is connected to and rotates with said actuator member, and said actuator member is a manually engageable member selected from the group consisting of a turn-knob or handle.

7. A latch assembly according to claim 1, wherein said retaining member is responsive to operation of said lock release means to disengage from said cam member and thereby permit said cam member to be driven into said first position by said cam biasing means.

8. A latch assembly according to claim 1, wherein retainer biasing means urges said retaining member into a position at which it is engageable with said cam member when said lock release means is inoperative, and said lock release means is operable to move said retaining member out of that position against the influence of said retainer biasing means.

9. A latch assembly according to claim 1, wherein said retaining member is engageable with said cam member when said locking means is inactive and is thereby operable to cause said cam member to move from said first position to said second position when said locking means is being transformed from the inactive condition to the active condition.

10. A latch assembly according to claim 1, wherein said first actuator, said cam member and said retaining member are rotatable about a common axis, and said retaining member is movable generally in the direction of that axis when moving into or out of engagement with said cam member.

11. A latch assembly according to claim 1, wherein said locking means includes detent means which is movable between an actuator locking position and an actuator release position which correspond to said active and inactive conditions respectively of said locking means, and said cam member is operable to control which of said positions is adopted by said detent means.

12. A latch assembly according to claim 11, wherein said cam member is movable about an axis of rotation between said first and second positions so as to thereby control said detent means, and said detent means includes at least one detent which moves substantially radially of said cam axis when moving between said actuator locking and release positions.

13. A latch assembly according to claim 12, wherein said first actuator includes a member which is movable about an axis of rotation, and said detent is connected to said actuator member for rotation therewith and is operable to prevent said actuator member rotation when in said actuator locking position.

14. A latch assembly according to claim 13, wherein said cam member is connected to said actuator member so as to be capable of limited rotation relative thereto and thereby adopt either said first or said second position of rotation.

15. A latch assembly according to claim 14, wherein said cam member includes a laterally extending arm which is located between two stops provided on said actuator member, and said relative rotation of the cam member is limited by the distance through which said arm can travel between said stops.

16. A latch assembly according to claim 15, wherein cam biasing means acts on said cam member to urge it into said first position of rotation at which said detent is able to adopt said actuator release position.

17. A latch assembly according to claim 16, wherein said cam biasing means includes a spring which acts between said arm and said actuator member so as to urge said cam member towards one of said stops.

18. A latch assembly according to claim 17, wherein said cam member holds said detent in said actuator locking position when said cam member is in said second position of rotation and said arm at or adjacent the other said stop.

19. A latch assembly according to claim 13, wherein said detent is connected to a hub of said actuator member and protrudes beyond an outer surface of said hub and engages with a relatively fixed part of said casing when in said actuator locking position.

20. A latch assembly according to claim 12, including two said detents each of which is located on a respective one of two opposite sides of said cam axis.

21. A latch assembly according to claim 16, wherein retaining means is operable to prevent the locking means adopting said inactive condition under the influence of said cam biasing means.

22. A latch assembly according to claim 21, wherein said retaining means includes a retaining member which is movable between a cam retaining position at which it prevents movement of said cam member from said second position of rotation to said first position of rotation, and a cam releasing position at which it permits such movement of the cam member.

23. A latch assembly according to claim 22, wherein a retainer biasing means urges said retaining member into said cam retaining position.

24. A latch assembly according to claim 22, wherein said retaining member moves generally in the direction of said cam axis when moving between said cam retaining and cam releasing positions.

25. A latch assembly according to claim 22, wherein said retaining member is engageable with said cam member when in said cam retaining position and is not so-engageable when in said cam releasing position, and when said cam member is in said second position of rotation it is prevented by said engagement from moving into said first position of rotation.

26. A latch assembly according to claim 22, wherein said lock release means includes a camming member which responds to operation of said second actuator to cause said retaining member to move into said cam releasing position.

27. A latch assembly according to claim 26, wherein said camming member is mounted for rotation about said actuator member axis between an active position at which it causes said retaining member to adopt said cam releasing position, and an inactive position at which it permits said retaining member to adopt said cam retaining position.

28. A latch assembly according to claim 12, wherein said first actuator includes a member which is movable about an axis of rotation, and said cam axis is substantially coincident with said actuator member axis.

29. A latch assembly according to claim 1, wherein said first actuator includes a key operated lock.

30. A latch assembly according to claim 29, wherein said first actuator includes a member which is movable about an axis of rotation, and said first actuator lock includes a barrel mounted for rotation relative to said actuator member about said axis of that member.

31. A latch assembly according to claim 22, wherein said retaining member is engageable with said cam member when said locking means is inactive and is thereby operable to cause said cam member to move from said first position to said second position when said locking means is being transformed from the inactive condition to the active condition.

32. A latch assembly according to claim 31, wherein said retaining member is connected to said locking means so as to move relative to said first actuator in response to said locking means being operated to adopt said active condition, and is thereby operable to move said cam member from said first position of rotation to said second position of rotation.

* * * * *